US005132708A

United States Patent [19]

Schmidlin et al.

[11] Patent Number: 5,132,708

[45] Date of Patent: Jul. 21, 1992

[54] DEP APPARATUS FOR SELECTIVELY CREATING MONOCHROME HIGHLIGHT COLOR OR PROCESS COLOR IMAGES

[75] Inventors: Fred W. Schmidlin, Pittsford; Raymond W. Stover, Webster, both of N.Y.

[73] Assignee: Xerox Corporation, Stamford, Conn.

[21] Appl. No.: 548,330

[22] Filed: Jul. 2, 1990

[51] Int. Cl.[5] ..... G03G 15/01

[52] U.S. Cl. ..... 346/157; 355/327; 355/328

[58] Field of Search ..... 346/157, 160.1; 355/326–328

[56] References Cited

U.S. PATENT DOCUMENTS

| | | | |
|---|---|---|---|
| 3,689,935 | 9/1972 | Pressman et al. | 346/74 ES |
| 4,078,929 | 3/1978 | Gundlach | 430/42 |
| 4,491,855 | 1/1985 | Fujii et al. | 346/159 |
| 4,568,955 | 2/1986 | Hasoya et al. | 346/153.1 |
| 4,810,604 | 3/1989 | Schmidlin | 346/157 X |
| 4,860,035 | 8/1989 | Meuleman et al. | 346/157 |
| 4,914,482 | 4/1990 | Ammenheuser et al. | 355/312 |
| 4,989,020 | 1/1991 | Namba | 346/157 |

*Primary Examiner*—George H. Miller, Jr.

[57] ABSTRACT

A Direct Electrostatic Printer including a vacuum drum for transporting copy sheets past a plurality of DEP printhead structures for selectively printing various types of images. For example, black only images, highlight color images or process color images may be printed. To this end there are provided a plurality of printheads each utilizing a different color toner. Each printhead structure may be selectively actuated depending upon whether its color is to be used in forming the final image. Thus, where a process color image is to be formed, all of the printheads may be actuated and where black images are to be created only the black printhead is actuated.

30 Claims, 3 Drawing Sheets

DEP APPARATUS FOR SELECTIVELY CREATING MONOCHROME HIGHLIGHT COLOR OR PROCESS COLOR IMAGES

BACKGROUND OF THE INVENTION

This invention relates to a Direct Electrostatic Printing (DEP) devices and more particularly to DEP wherein multiple printhead structures are employed for the selective printing of highlight color, process color or monochrome images.

Of the various electrostatic printing techniques, the most familiar is that of xerography wherein latent electrostatic images formed on a charge retentive surface are developed by a suitable toner material to render the images visible, the images being subsequently transferred to plain paper.

A less familiar form of electrostatic printing is one that has come to be known as Direct Electrostatic Printing (DEP). This form of printing differs from the aforementioned xerographic form, in that, the toner or developing material is deposited directly onto a plain substrate in image configuration. This type of printing device is disclosed in U.S. Pat. No. 3,689,935 issued Sept. 5, 1972 to Gerald L. Pressman et al.

Pressman et al disclose an electrostatic line printer incorporating a multilayered particle modulator or printhead comprising a layer of insulating material, a continuous layer of conducting material on one side of the insulating layer and a segmented layer of conducting material on the other side of the insulating layer. At least one row of apertures is formed through the multilayered particle modulator. Each segment of the segmented layer of the conductive material is formed around a portion of an aperture and is insulatively isolated from every other segment of the segmented conductive layer. Selected potentials are applied to each of the segments of the segmented conductive layer while a fixed potential is applied to the continuous conductive layer. An overall applied field projects charged particles through the row of apertures of the particle modulator and the density of the particle stream is modulated according to the pattern of potentials applied to the segments of the segmented conductive layer. The modulated stream of charged particles impinge upon a print-receiving medium interposed in the modulated particle stream and translated relative to the particle modulator to provide line-by-line scan printing. In the Pressman et al device the supply of the toner to the control member is not uniformly effected and irregularities are liable to occur in the image on the image receiving member. High-speed recording is difficult and moreover, the openings in the printhead are liable to be clogged by the toner.

U.S. Pat. No. 4,491,855 issued on Jan. 1, 1985 in the name of Fujii et al discloses a method and apparatus utilizing a controller having a plurality of openings or slit-like openings to control the passage of one-component insulative magnetic toner and to record a visible image by the charged particles directly on an image receiving member. Fujii, et al. show an apertured printhead structure having wedge-shaped apertures wherein the larger diameter of an aperture is delineated by a signal or control electrode and is disposed opposite an image receiving substrate.

U.S. Pat. No. 4,568,955 issued on Feb. 4, 1986 to Hosoya et al discloses a recording apparatus wherein a visible image based on image information is formed on an ordinary sheet by a developer. The recording apparatus comprises a developing roller spaced at a predetermined distance from and facing the ordinary sheet and carrying the developer thereon. It further comprises a recording electrode and a signal source connected thereto for propelling the developer on the developing roller to the ordinary sheet by generating an electric field between the ordinary sheet and the developing roller according to the image information. A plurality of mutually insulated electrodes are provided on the developing roller and extend therefrom in one direction. An A.C. and a D.C. source are connected to the electrodes, for generating an alternating electric field between adjacent ones of the electrodes to cause oscillations of the developer found between the adjacent electrodes along electric lines of force therebetween to thereby liberate the developer from the developing roller. In a modified form of the Hosoya et al device, a toner reservoir is disposed beneath a recording electrode which has a top provided with an opening facing the recording electrode and an inclined bottom for holding a quantity of toner. In the toner reservoir are disposed a toner carrying plate as the developer carrying member, secured in a position such that it faces the end of the recording electrode at a predetermined distance therefrom and a toner agitator for agitating the toner.

Two xerographic color printing engines to which some degree of attention has been focused in the past are the tandem systems utilizing as many as four, sequentially disposed engines and a four-cycle belt configuration. The tandem engine system provides the maximum throughput for a given process speed but requires a maximum number of parts at a relatively large cost and has the potential for impacting system reliability. Each engine, for example, requires separate charging, exposure, develop and cleaning components.

The xerographic four cycle system minimizes the page throughput for a given process speed but reduces the number of parts and has the potential for maximum reliability at minimal cost. However, using four conventional developer housings in connection with one image receiving belt maximizes subsystem interaction and has the potential for causing copy quality defects due to materials interaction.

BRIEF SUMMARY OF THE INVENTION

Briefly, the present invention provides a single pass color printer that utilizes a minimum number of parts making up the individual image forming members with a minimum degree of subsystem interaction.

The printer of the present invention comprises a vacuum drum for transporting image receiving sheets past a plurality of DEP printhead structures for selectively printing various types of images. For example, black only images, highlight color images or process color images may be printed. To this end there are provided a plurality of printheads each utilizing a different color toner. Each printhead structure may be selectively actuated depending upon whether its color is to be used in forming the final image. Thus, where a process color image is to be formed, all of the printheads are actuated and where black images are to be created only the black printhead is actuated.

The vacuum drum is provided with a plurality of vacuum chambers connected to a vacuum source. Porous sections are provided in the drum surface adjacent the chambers for tacking the image receiver sheets to the drum for movement past the plurality of printhead structures. Three of the chambers are provided for tacking the lead and trailing portions of the sheets to the drum. The remaining chamber is utilized to sequentially remove unwanted toner from the printhead structures. One of the chambers is also connected to a source of positive air pressure for lifting the lead edge of a receiver sheet from the drum so that it can be fed into the nip of a heat and pressure fuser.

Suitable timing marks are provided on the surface of the drum for actuating the printhead structures and the valves controlling the vacuum and positive pressure sources. A suitable sensor, for example, a light emitting diode (LED) and photodiode or photodetector diode is employed for deriving output signals from the timing marks for actuating the valves at the appropriate times and for enabling the printhead structures.

An Electronic Subsystem (ESS) processes information to be printed and conditions the printhead structures for printing at the appropriate times.

DETAILED DESCRIPTION OF THE PREFERRED EMBODIMENT OF THE INVENTION

Figure 1:
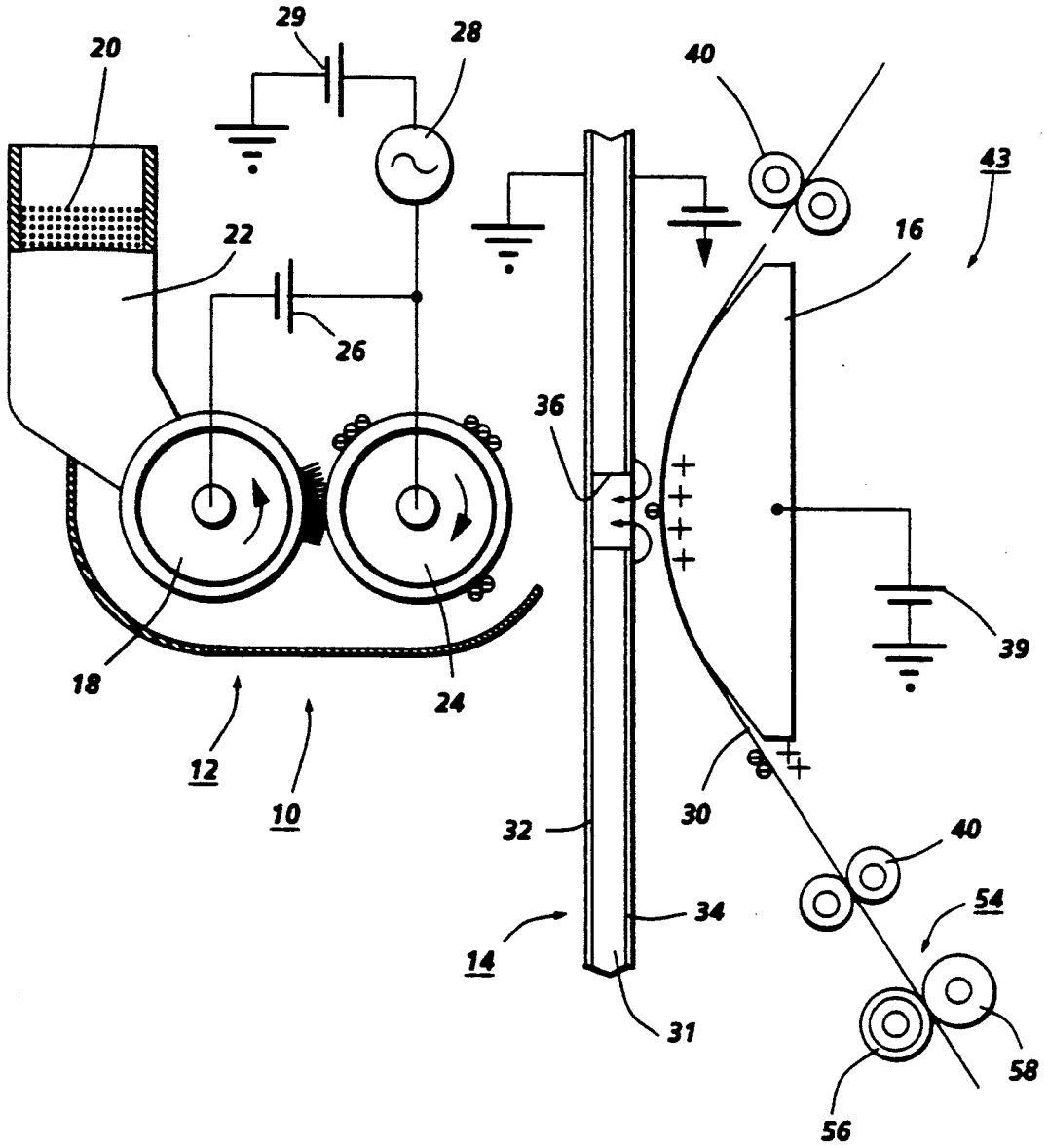
FIG. 1 (PRIOR ART)
FIG. 1 is a schematic illustration of a Direct Electrostatic Printing device depicting the basic operation of such devices.

Disclosed in FIG. 1 is an embodiment of a Direct Electrostatic Printing apparatus 10 depicting the basic operation of such devices.

The printing apparatus 10 includes a developer delivery system generally indicated by reference character 12, a printhead structure 14 and a backing electrode or shoe 16.

The developer delivery system 12 includes a conventional magnetic brush 18 supported for rotation adjacent a supply of toner 20 contained in a hopper 22. A developer donor roll 24 is supported for rotation intermediate the magnetic brush 18 and the printhead structure 14. The donor roll structure is coated with Teflon-S (Trademark of E.I. dupont) and is spaced from the printhead approximately 0.003 to 0.015 inch. Teflon-S is a tetrafluoroethylene fluorocarbon polymer that is loaded with carbon black. The magnetic brush has a dc bias of about 200 volts applied thereto via a dc voltage source 26. An AC voltage of about 400 volts at 3 KHz provided by source 28 with a dc bias of 20 volts provided by source 29 is applied to the donor roll 24. The applied voltages are effective to cause transfer of a monolayer of toner from the brush 18 to the donor roll 24. The monolayer is subsequently jumped to the vicinity of the apertures of the printhead. The 20 volts dc bias precludes collection of right sign toner on the shield electrode of the printhead.

The developer preferably comprises any suitable insulative non-magnetic or magnetic toner/carrier combination having Aerosil (Trademark of Degussa, Inc.) contained therein in an amount equal to ½% by weight and also having zinc stearate contained therein in an amount equal to 1% by weight. As will be apparent to those skilled in the art, different developers with different amounts of additives require different operating conditions for optimal control of the toner flow.

The printhead structure 14 comprises a layered member including an electrically insulative base member 31 fabricated from a polyimide film approximately 0.001 inch thick. The base member is clad on the one side thereof with a continuous conductive layer or shield 32 of aluminum which is approximately one micron thick. The opposite side of the base member 30 carries segmented conductive layer 34 thereon which is fabricated from aluminum. A plurality of holes or apertures 36, (only one of which is shown) approximately 0.15 mm in diameter are provided in the layered structure in a pattern suitable for use in recording information. The apertures form an electrode array of individually addresable electrodes. With the shield grounded and zero to +50 volts applied to an addressable electrode, toner is propelled through the aperture associated with that electrode. The aperture extends through the base 31 and the conductive layers 32 and 34.

With a negative 300 volts applied to an addressable electrode toner is prevented from being propelled through the aperture. Image intensity can be varied by adjusting the voltage on the control electrodes between 0 and minus 300 volts. Addressing of the individual electrodes can be effected in any well known manner in the art of printing using electronically addressable printing elements. During printing the shoe 16 is electrically biased to a dc potential of approximately 400 volts via a dc voltage source 39.

Figure 2:
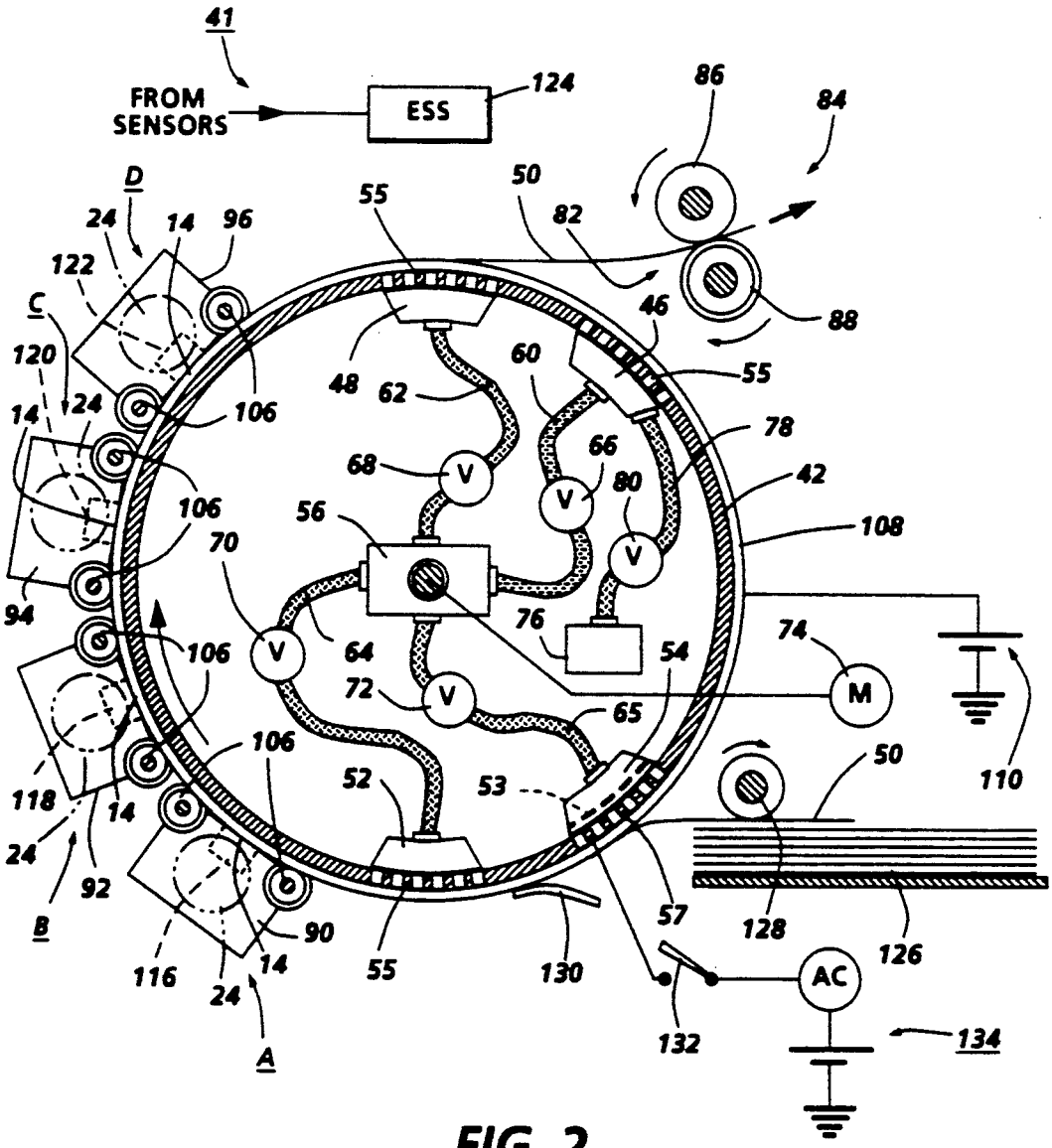
FIG. 2 is a schematic illustration of a Direct Electrostatic Printing apparatus according to the present invention.
Figure 3:
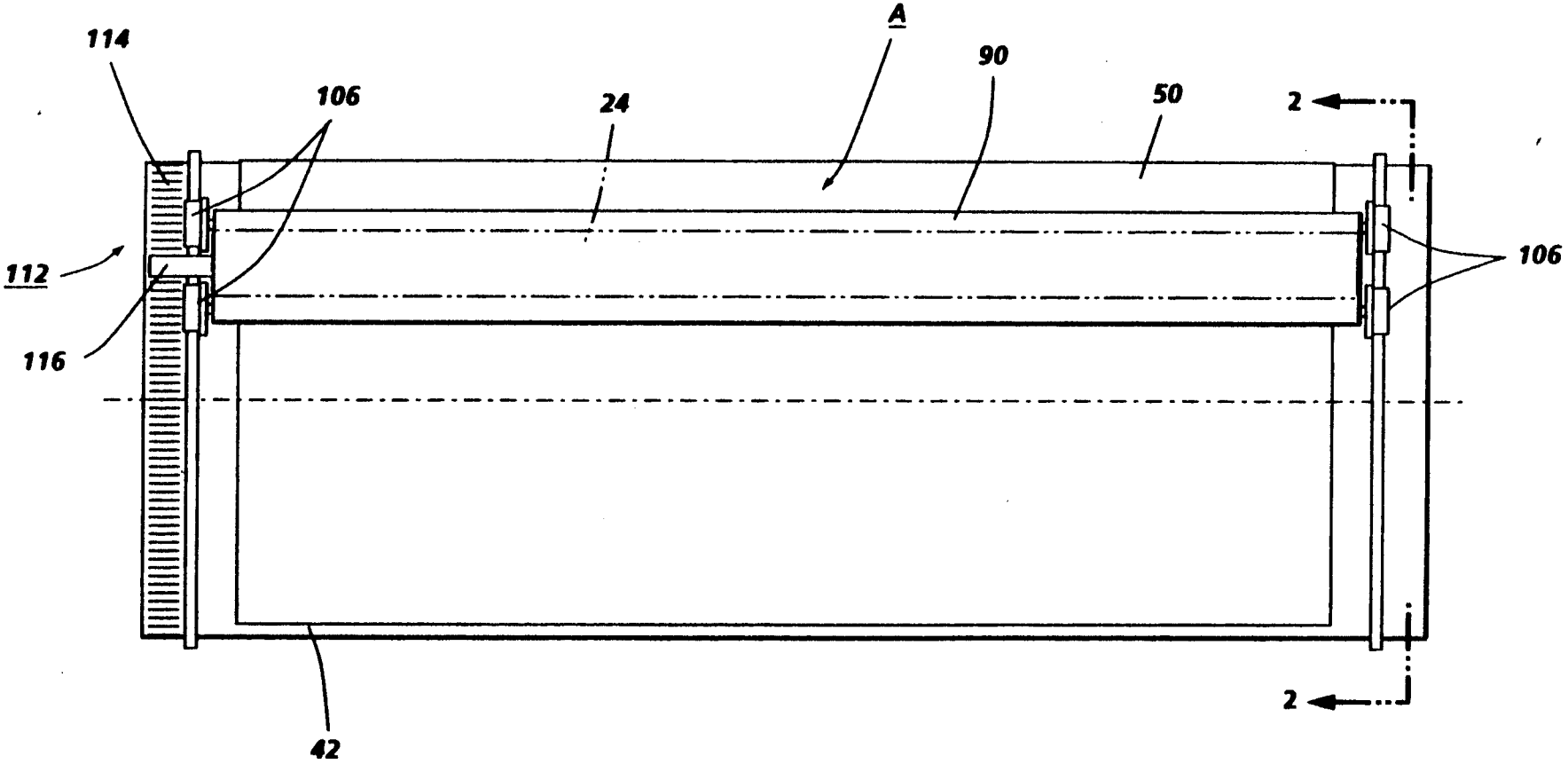
FIG. 3 is an illustration of a vacuum drum and one printhead structure forming a part of the apparatus depicted in FIG. 2.

In the present invention as shown in FIGS. 2 and 3, the electrode or shoe 16 and paper transport roller pairs 40 of FIG. 1 are replaced, in the printer 41 of the present invention, by a vacuum drum 42 and its associated components as will be discussed herein after. The drum is supported for clockwise rotation past a plurality of print stations A, B, C and D. The circumference of the vacuum drum 42 is of sufficient length to accommodate a sheet of plain paper plus an air chamber 54. Fitted within the circumference of the drum are two air chambers 46 and 48 for tacking the lead edges of sheets of plain paper 50 to the drum. The drum further has incorporated therein air chamber 52 for tacking the trail edge of a sheet 50 to the drum and air chamber 54 for removing unwanted toner particles from the various printhead structures associated with the drum structure 42. The chambers 46, 48, and 52 communicate with the exterior surface of the drum via conductive porous plates 55. Chamber 54 communicates with the exterior surface of the drum via conductive aperture plate 57 which is electrically insulated from the drum and connected through switch 132 to AC/DC voltage supply via a flexible cable of slip ring (not shown), the latter in the case of a unidirectionally rotating drum. A filter 53 asociated with chamber 54 serves to filter toner.

A vacuum source 56 is operatively connected to the chambers 46, 48, 52 and 54 via flexible conduits 60, 62, 64 and 65 and electrically actuated valves 66, 68, 70 and 72. The conduits are long enough and flexible enough to allow the drum 42 to be rotated one complete revolution in the clockwise direction via a motor 74 after which the drum rotation is reversed so that the drum makes one complete rotation back to its starting position for movement of a subsequent image receiver through the print stations. While the disclosed embodiment illustrates flexible conduits for operatively connecting the chambers 46 through 54 to the air sources it will be appreciated by those skilled in the art that connection may be otherwise accomplished. For example, a single, stationary air manifold chamber of a continuously rotating drum could be connected to a vacuum pump that is evacuated through a slip connection.

The chamber 46 also has connected thereto a source of positive air pressure 76 via flexible flexible conduit 78 and electrically actuated valve 80. At the appropriate time, the chamber 46 is disconnected from the vacuum source 56 and connected to the positive air source 76 for the purpose of forcing the lead edge of the receiver material 50 away from the drum so that it is directed into the nip of 82 of heat and pressure fuser 84.

The fuser 82 permanently affixes toner powder images to sheets 50. Preferably, fuser assembly 84 includes a heated fuser roller 86 adapted to be pressure engaged with a back-up roller 88 with the toner powder images contacting fuser roller 86. In this manner, the toner powder image is permanently affixed to substrate 50. After fusing, chute, not shown, guides the advancing sheet 50 to a catch tray (not shown) for removal from the printing machine by the operator.

Combination printhead and toner delivery systems 90, 92, 94 and 96, each similar in construction to the combination of printhead structure 14 and toner delivery system 12 are provided at the print stations A through D. Each of the toner delivery systems associated with the members 92 through 96 utilizes a different color toner. For example, the member 96 may use magnetic or non-magnetic black toner while the members 90 through 94 may use yellow, magenta and cyan respectively. Each of the printhead structures of the systems 90 through 96 includes spacer wheels 106 that ride against the drum and assure constant image receiver spacing relative to the printhead (sensitive only to runout in the small spacer wheels). The longitudinal position of the printheads is controlled by annular tracks 108 for the spacer wheels to ride on. Alternatively, a wheel that runs against the end of the drum may be provided for this purpose. The end wheel provides greater simplicity and it enables incorporation of different thickness spacer bands on the surface of the drum for the spacer wheels to run on and thereby accommodate a variety of paper thickness ranges.

During printing the drum 42 is electrically biased to a dc potential of approximately 400 volts via a dc voltage source 110.

As illustrated in FIG. 3, the surface of the drum 42 is provided with a timing track 112 comprising timing marks 114. The timing marks 114 are read with sensors 116, 118, 120 and 122, carried by the printheads. LED/Detector combinations may be employed as the sensors. The sensors are used to slave the electronics driving each printhead to the positioning of the timing marks and thereby provide for accurate registration of the different color prints produced by the respective print stations. This eliminates the need for an accurately controlled drum speed which is an obvious alternative registration means. The electronics driving each of the printhead structures form part of an Electronic Subsystem (ESS) 124 and may comprise well known structure in the art for electronically addressing the individual electrodes.

Each of the printhead sensors also generates signals for actuating the electronically actuated valve 72 and switch 132 which are processed by the ESS. Thus, as the chamber 54 moves into the various print stations, the vacuum source 56 and the cleaning voltage source 134 are actuated for effecting removal of the unused toner particles that may have collected on the printhead structures while printing a previous page. The valves 66, 68 and 70 are actuated by signals generated by a timing mark sensor sensor 116 to thereby provide vacuum in the chambers 46, 48 and 52 at the appropriate times for tacking the image receiver sheets to the drum. The valve 80 is also actuated in response to signals generated by the sensor 116 for connecting the positive pressure source 76 to the chamber 46 for lifting the lead edge of the image receiver sheets from the drum 42. The valve 66 providing vacuum to the chamber 46 is simultaneously deactivated via signals from the sensor 116 when the valve 80 is actuated.

The image receiving sheets 50 comprises cut sheets of paper fed from a supply tray 126 via a conventional feed wheel 128. The sheets of paper are spaced from the printhead structure via the spacer wheels a distance in the order of 0.001 to 0.010 inch as they pass thereby. A pressure blade 130 which contacts the drum 42 serves to ensure that the lead edge of image receivers 50 make proper contact with the surface of the vacuum drum 42.

The printer apparatus 41 can be used for black, highlight color (where one of the toners could be a different color or have different properties such as being magnetic for printing bank checks or the like) and process color. When the timing marks 112 are sensed by a particular printhead sensor, if the electronic controls of that printhead have received information to be printed from the ESS then an image is printed otherwise an image corresponding to that printhead is omitted. Whether highlight color or process color is effected depends on the information received in the electronics. In any event, the appropriate apertures of the respective printhead structures are actuated in accordance with the type of image to be printed and their printing is synchronized in the case of multiple color images such that the toners either overlap (process color) or do not (highlight color).

What is claimed is:

1. Printing apparatus comprising:

a plurality direct electrostatic printhead structures disposed at print stations;

a plurality of toner delivery systems for delivering different types of toner to said printhead structures;

means for moving image receivers through said print stations and past said printhead structures in a single pass;

means for selectively actuating said printhead structures for forming one of a plurality of different kinds of images.

2. Apparatus according to claim 1 wherein said different kinds of images are highlight color, process color and monochrome images.

3. Apparatus according to claim 2 wherein said means for moving image receivers comprises a vacuum drum.

4. Apparatus according to claim 3 wherein said vacuum drum comprises a plurality of vacuum chambers for tacking the lead and trail edge portions of an image receiver to said drum.

5. Apparatus according to claim 4 wherein said vacuum drum further comprises a vacuum chamber for removing unwanted toner particles form each of said printhead structures.

6. Apparatus according to claim 5 wherein said means for selectively actuating said printhead structures comprises timing marks carried by said vacuum drum and sensor apparatus for generating signals in response to the sensing of said timing marks, said signals being processed by an electronic subsystem.

7. Apparatus according to claim 6 wherein said electronic subsystem comprises means for controlling said printhead structures in accordance with information to be printed in image configuration.

8. Apparatus according to claim 7 including means for spacing said printhead structures a predetermined distance from an image receiver on said drum.

9. Apparatus according to claim 8 wherein said distance is in the order of 0.001 to 0.010 inch.

10. Apparatus according to claim 9 wherein said means for spacing said printhead structures comprises rollers carried by said printhead structures and tracks carried by said drum.

11. Apparatus according to claim 2 wherein said means for selectively actuating said printhead structures comprises timing marks carried by said means for moving image receivers and sensor apparatus for generating signals in response to the sensing of said timing marks, said signals being processed by an electronic subsystem.

12. Apparatus according to claim 11 wherein said electronic subsystem comprises means for controlling said printhead structures in accordance with information to be printed in image configuration.

13. Apparatus according to claim 2 including means for spacing said printhead structures a predetermined distance from an image receiver on said drum.

14. Apparatus according to claim 13 wherein said distance is in the order of 0.001 to 0.010 inch.

15. Apparatus according to claim 14 wherein said means for spacing said printhead structures comprises rollers carried by said printhead structures and tracks carried by said drum.

16. Printing apparatus comprising a plurality of direct electrostatic printing structures for depositing developer material in image configuration on an image receiver;

means for moving image receivers past said direct electrostatic printing structures in a single pass;

means for selectively actuating said printing structures for forming one of a plurality of different kinds of images.

17. Apparatus according to claim 16 wherein said different kinds of images are highlight color, process color and monochrome images.

18. Apparatus according to claim 17 wherein said means for moving image receiver comprises a vacuum drum.

19. Apparatus according to claim 18 wherein said vacuum drum comprises a plurality of vacuum chambers for tacking the lead and trail edge portions of an image receiver to said drum.

20. Apparatus according to claim 19 wherein said vacuum drum further comprises a vacuum chamber for removing unwanted toner particles from each of said printhead structures.

21. Apparatus according to claim 20 wherein said means for selectively actuating said printhead structures comprises timing marks carried by said vacuum drum and sensor apparatus for generating signals in response to the sensing of said timing marks, said signals being processed by an electronic subsystem.

22. Apparatus according to claim 21 wherein said electronic subsystem comprises means for controlling said printhead structures in accordance with information to be printed in image configuration.

23. Apparatus according to claim 22 including means for spacing said printhead structures a predetermined distance from an image receiver on said drum.

24. Apparatus according to claim 23 wherein said distance is in the order of 0.001 to 0.010 inch.

25. Apparatus according to claim 24 wherein said means for spacing said printhead structures comprises rollers carried by said printhead structures and tracks carried by said drum.

26. Apparatus according to claim 17 wherein said means for selectively actuating said printhead structures comprises timing marks carried by said means for moving image receivers and sensor apparatus for generating signals in response to the sensing of said timing marks, said signals being processed by an electronic subsystem.

27. Apparatus according to claim 26 wherein said electronic subsystem comprises means for controlling said printhead structures in accordance with information to be printed in image configuration.

28. Apparatus according to claim 17 including means for spacing said printhead structures a predetermined distance from an image receiver on said drum.

29. Apparatus according to claim 28 wherein said distance is in the order of 0.001 to 0.010 inch.

30. Apparatus according to claim 29 wherein said means for spacing said printhead structures comprises rollers carried by said printhead structures and tracks carried by said drum.

* * * * *